US006300279B1

(12) United States Patent
Macedo

(10) Patent No.: US 6,300,279 B1
(45) Date of Patent: Oct. 9, 2001

(54) METHOD FOR APPLYING DECORATIVE DESIGNS TO WOOD SUBSTRATES

(76) Inventor: Joseph Macedo, 146 Munn Ave., Teaneck, NJ (US) 07666

( * ) Notice: Subject to any disclaimer, the term of this patent is extended or adjusted under 35 U.S.C. 154(b) by 0 days.

(21) Appl. No.: 09/539,592

(22) Filed: Mar. 31, 2000

(51) Int. Cl.[7] ..... B41M 5/035; B41M 5/38
(52) U.S. Cl. ..... 503/227; 428/913; 428/914
(58) Field of Search ..... 8/471; 428/913, 428/914; 503/227

(56) References Cited

U.S. PATENT DOCUMENTS

| | | | |
|---|---|---|---|
| 4,354,851 | 10/1982 | Hix et al. | 8/471 |
| 4,422,854 | 12/1983 | Hähnle et al. | 8/471 |
| 4,462,852 | 7/1984 | Custor | 156/231 |
| 4,465,728 | 8/1984 | Haigh et al. | 428/156 |
| 4,596,190 | 6/1986 | Hanstein et al. | 101/470 |
| 4,599,259 | 7/1986 | Kobayashi et al. | 428/204 |
| 4,664,672 | 5/1987 | Krajec et al. | 8/472 |
| 4,668,560 | 5/1987 | Kabayashi et al. | 428/195 |
| 4,695,286 | 9/1987 | Vanier et al. | 8/471 |
| 4,842,613 | 6/1989 | Purser | 8/471 |
| 4,908,345 | 3/1990 | Egashira et al. | 503/227 |
| 4,912,085 | 3/1990 | Marbrow | 503/227 |
| 5,024,989 | 6/1991 | Chiang et al. | 503/227 |
| 5,030,612 | 7/1991 | Uytterhoeven et al. | 503/227 |
| 5,112,361 | 5/1992 | Carrington et al. | 8/471 |

*Primary Examiner*—Bruce H. Hess
(74) *Attorney, Agent, or Firm*—White & Case LLP

(57) ABSTRACT

A process for transferring a decorative sublimation dye design formed on a transfer sheet to a wood substrate by applying a sheet of cellulose web material impregnated with a thermosetting resin to at least one surface of a wood substrate. The thermosetting resin impregnated sheet of cellulose web material is consolidated to the wood substrate under heat and pressure such that the thermosetting resin has seeped into the pores of the wood substrate to form a thermofused substrate. The transfer sheet is brought into contact with the surface of the thermofused substrate and heat and pressure are applied to the transfer sheet and thermofused substrate to cause penetration of the design on the transfer sheet into the thermofused substrate through a sublimation process. The transfer sheet is then from the surface of the thermofused substrate.

11 Claims, 2 Drawing Sheets

METHOD FOR APPLYING DECORATIVE DESIGNS TO WOOD SUBSTRATES

FIELD OF THE INVENTION

The invention generally relates to methods for applying decorative designs to wood substrates using sublimation dyes.

BACKGROUND OF THE INVENTION

With the widespread use of wood substrates in business and in the home, e.g., walls, countertops, furniture, etc., the need for suitably decorating wood substrates is obvious. However, wood surfaces are not as receptive as other substances, e.g., paper, to the printing of decorations directly on their surface. Decorations printed directly on wood substrates are prone to abrasion, fading, and other types of wear and tear.

It is generally known that substrates can be decorated by applying a decoration such as by printing to a transfer sheet, bringing the decorated transfer sheet into contact with a substrate, and by the application of heat and pressure, transferring the decoration from the transfer sheet to the surface of the substrate. It is also known that by using sublimation dyes which vaporize when heated, the decoration can be made to penetrate or bleed into the body of the substrate. However, a process for transferring decorative designs from transfer sheets to wood substrates such that the decoration penetrates the body of the wood substrate has been elusive.

U.S. Pat. No. 4,354,851, issued Oct. 19, 1982 to Hix et al., discloses a method for producing a decorated substrate by bringing a sheet printed with a design that is formed by a sublimable coloring agent, and transferring the design to a pre-coated rigid panel having a clear, water-resistant polymeric coating. It is preferred that the surface coating be selected from alkyl-melamine resins, polyester resins, alkyl resins and acrylic polymers. The rigid panel forming substrate may be a cellulosic formed board such as hardboard, particle board, softboard, insulation board, or it may be a coated gypsum panel or a coated plywood panel. The coated surface of the panel and the decorated surface of the printed sheet are brought into physical contact. While their surfaces are maintained in contact, light pressure and heat is applied to sublime the coloring agent and cause it to be transferred to and penetrate into the polymeric coating on the surface of the rigid panel.

U.S. Pat. No. 4,908,345, issued Mar. 13, 1990 to Egashire et al., discloses a thermal dye transfer system comprising a dye layer containing a fusible or sublimable dye, a sheet substrate and a dye receiving layer formed on at least one surface of the sheet substrate for receiving the dye. The substrate can be a natural fiber paper such as cellulose fiber paper. A specific feature of the dye receiving sheet is that the receiving layer comprises a specific modified polyester resin. As a result, it is reported that the dyeability and light resistance of the image can be improved.

U.S. Pat. No. 5,030,612, issued Jul. 9, 1991 to Uytterhoeven et al., discloses a thermal dye sublimation transfer recording element for receiving sublimable basic dye-precursors. U.S. Pat. No. 3,860,388, issued Jan. 14, 1975 to John M. Haigh, discloses a method for dye absorption into plastic sheets by placing polyethylene film between a dye transfer paper and a plastic sheet, where the application of heat and pressure causes the dye to migrate through the polyethylene on the surface of the plastic sheet.

There still remains the need for a cost-efficient process for the manufacture of decorated wall board panels that are advantageously distinguished by an improvement in properties including dyeability, weathering resistance and cleanability.

OBJECTS OF THE INVENTION

It is an object of the invention to provide a practical commercial process for producing decorative wood. Another object of the invention is to produce novel decorative wood substrates. Other objects and the advantages of the invention will appear from the following description of the preferred embodiment.

SUMMARY OF THE INVENTION

The present invention relates to a process for transferring a decorative sublimation dye design formed on a transfer sheet to a wood substrate. In accordance with the process defining the invention, a sheet of cellulose web material impregnated with a thermosetting resin, such as polyester, is applied to at least one surface of a wood substrate. Paper is an example of a cellulose web material that can be used in the invention. While the surfaces are in contact, the polyester-impregnated paper is consolidated to the wood substrate under heat and pressure such that the polyester seeps into the pores of the wood substrate to form a thermofused substrate. A transfer sheet is brought into contact with the surface of the thermofused substrate. Heat and pressure are applied to the transfer sheet and thermofused substrate to cause penetration of the design on the transfer sheet into the thermofused substrate through a sublimation process. The transfer sheet is separated from the surface of the thermofused substrate. Optionally, a protective coating is applied over the surface of the substrate showing the transferred design.

DESCRIPTION OF THE PREFERRED EMBODIMENT

Figure 1:
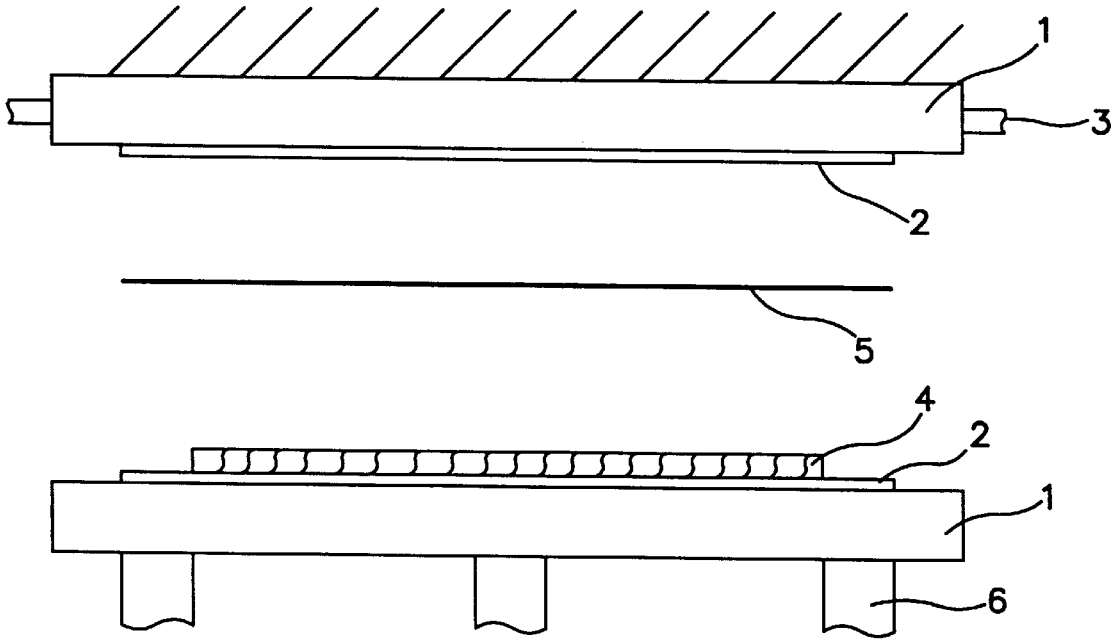
FIG. 1 is a schematic drawing of an embodiment of the invention according to which a cellulose web material impregnated with a thermosetting resin is consolidated to a web substrate under heat and pressure using an oil press to form a thermofused substrate.

The present invention concerns a process for transferring a decorative sublimation dye design formed on a transfer sheet to a wood substrate. In the procedure of the invention, one surface of a sheet of cellulose web material impregnated with a thermosetting resin is applied to at least one surface of a wood substrate. The thermosetting resin impregnated sheet of cellulose web material is consolidated to the wood substrate under heat and pressure such that the thermosetting resin seeps into the pores of the wood substrate to form a thermofused substrate. The thermofused structure is formed at a temperature of about 260° F. to about 270° F. and at a pressure of about 1200 PSI to about 1280 PSI.

The transfer sheet is then brought into contact with the surface of the thermofused substrate which was consolidated with the thermosetting resin impregnated sheet of cellulose web material. Heat and pressure are applied to the transfer sheet and thermofused substrate to cause penetration of the design on the transfer sheet into the thermofused substrate through a sublimation process. The design is transferred and penetrated into the surface of the wood substrate at a temperature of about 350° F. to about 385F and a pressure of about 40 PSI to about 70 PSI. The transfer sheet is then separated from the surface of the thermofused substrate.

Optionally, a protective coating, for example, a UV cured polyester topcoat, is applied over the surface of the thermofused substrate showing the transferred design.

Paper is an example of a cellulose web material that can be used in the invention. In accordance with the preferred embodiment, the cellulose web material is impregnated with polyester. As the wood substrate, it is possible to use MDF, plywood, isoboard, veneer core, particle board and hard board.

The steps of the present invention are now described in detail.

A Resin-Saturated Sheet Is Applied to a Wood Substrate

Naked wood substrates are not receptive to sublimation dyes. However, thermofused substrates formed by the fusion of wood substrates with sheets of cellulose web material impregnated with a thermosetting resin are receptive to sublimation dyes. Therefore, in accordance with the invention, a sheet of cellulose web material impregnated with a thermosetting resin is applied to at least one surface of a wood substrate.

One example of cellulose web material suitable for impregnation with a thermosetting resin is paper. An example of a thermosetting resin that is suitable is polyester. Polyester tends to have performance properties very similar to melamine, a commonly used substance in the design of wood substrates. However, in contrast to melamine, polyester is receptive to image imprinting with sublimation dyes. Table 1 provides the performance measurements of a surface overlaid with polyester in comparison to a surface overlaid with melamine in areas such as resistance to wear, resistance to stain, and cleanability. Specifically, the performance measurements were measured in accordance with NEMA (National Electrical Manufacturers Association) standards for decorative laminates.

TABLE 1

| | | Min. Requirements to Comply with ALA 1992 | | NEMA LD3 - 1991 GP-20 Min. | | |
|---|---|---|---|---|---|---|
| Tests for Resistance to | Test Description | Solid Colors | Wood Grains | Performance Standards | Polyester | Melamine |
| Wear | A measure of the ability of a decorative overlaid surface to maintain its design or color when subjected to abrasive wear. | 400 cycles | 125 cycles | 400 cycles | Solids-400+ W.G.- 125 | Solids-400+ W.G.- 125 |
| Scuff | A measure of the ability of a decorative overlaid surface to maintain its original appearance color when exposed to scuffing. | No effect | No effect | No effect | No effect | No effect |
| Stain | A measure of the ability of a decorative overlaid surface to resist staining or discoloration by contact with 29 common household substances. | No effect 1–23 Moderate 24–29 | No effect 1–23 Moderate 24–29 | No effect 1–23 Moderate 24–29 | No effect 1–28 SL effect 29 | No effect 1–28 SL effect 29 |
| Cleanability | A measure of the ability of a decorative overlaid surface to be cleaned using a sponge. | No effect. Surface cleaned in 10 or fewer strokes | No effect. Surface cleaned in 10 or fewer strokes | Slight | No effect | No effect |
| Light (4) | A measure of the ability of a decorative overlaid surface to retain its color after exposure to a light source having a frequency range approximating sunlight. | Slight | Slight | Slight | Slight | Slight |
| High Temp | A measure of the ability of a decorative overlaid surface to maintain its color and surface texture when subject to a high temp. (365 deg. F.) | Slight | Slight | Slight | Slight | Slight |
| Radiant Heat | A measure of the ability of a decorative overlaid surface to resist spot damage when subjected to a radiant heat source. | No effect up to 60 sec. | No effect up to 60 sec. | No effect up to 60 sec. | No effect | No effect |
| Boiling Water | A measure of the ability of a decorative overlaid surface to maintain its color and surface texture when subjected to boiling water. | No effect | No effect | No effect | No effect | No effect |

TABLE 1-continued

| Tests for Resistance to | Test Description | Min. Requirements to Comply with ALA 1992 | | NEMA LD3 - 1991 GP-20 Min. | | |
|---|---|---|---|---|---|---|
| | | Solid Colors | Wood Grains | Performance Standards | Polyester | Melamine |
| Impact | A measure of the ability of a decorative overlaid surface to resist fracture due to spot impact by a steel ball dropped from a measured height. | 15" without fracture | 15" without fracture | 15" without fracture | 15" without fracture | 15" without fracture |

Decorative surface performance measurements as measured by NEMA test procedures.

Paper impregnated with polyester for use in the invention can be obtained from Olon Industries located in Geneva, Illinois. The polyester impregnated paper is commonly referred to as "polyfilm." However, in general, polyester resins are introduced into paper during an impregnation operation. Polyester resins suitable for impregnating sheets of cellulose web material such as paper are formed by reacting di-functional acids with di-functional alcohols. This type of process is well known by those skilled in the art. The polyester resins are heated, for example in a cauldron, to the desired acid number and viscosity. The polyester resins are then dissolved in acetone. Finally, the solution, typically 45–55% polyester, is transferred to a dip tank.

The paper is saturated by dragging it through the dip tank. The acetone solvent is removed from the saturated paper by passing the saturated paper through a heated oven. Ideally, the polyester resin is metered to a final resin content of 56–60%, but resin content can be increased or decreased for special applications.

Optionally, aluminum oxide can be added to the polyester-acetone solution before it is transferred to the dip tank. Adding aluminum oxide to the solution ultimately results in improved performance measurements, including, increased wear resistance. Referring to Table 1 again, the addition of aluminum oxide would increase the wear resistance of the polyester-impregnated product to 4,000 to 6,000 cycles. Typically, if it is added, the aluminum oxide would constitute 2–4% of the solution that is transferred to the dip tank.

Referring to FIG. 1, two oil press platens 1 are positioned opposite each other. A smooth surface press platten 2 is affixed to the surface of each platen which faces the opposite platen. Placed between the two smooth surface press plattens 2, juxtaposed against the surface of one of the smooth surface press plattens, is a wood substrate 4. Placed between this wood substrate and the opposite smooth surface press platten 2 is the polyester-impregnated paper 5.

The polyester-impregnated paper 5 is consolidated to the wood substrate under the heat and pressure of the oil press such that the cellulose web material seeps into the pores of the wood substrate 4 to form a thermofused substrate. Examples of wood substrates suitable for fusion with a polyester-impregnated paper are MDF, plywood, isoboard, veneer core, and particle board, although many other types of wood substrates are also suitable. Different wood substrates will require different temperature-pressure-time combinations for the purpose of fusion with the polyester-impregnated paper.

Referring again to FIG. 1, hydraulic rams 6 press the platens together, thereby pressing together the polyester-impregnated paper and the wood substrate. One of the platens is heated (and cooled) by oil which enters the platen cavity via water ducts 3. Depending on the type of wood substrate, a particular pressure and temperature is maintained for the time required for the polyester to seep into the pores of the wood substrate to form the thermofused substrate. It is well within the skill of the person of ordinary skill in the art to determine the conditions to effect the desired seepage of the thermosetting resin into the wood pores. The platens are then cooled and pulled apart to their original position, and the thermofused substrate is removed from the oil press.

A Transfer Sheet Is Applied to the Thermofused Substrate

A transfer sheet having the sublimation dye design is brought into contact with the surface of the thermofused substrate which was consolidated with the thermosetting resin impregnated sheet of cellulose web material. In the accordance with the process of the invention, as opposed to drafting the design directly onto the surface of the thermofused substrate, the design is applied to the surface of the thermofused substrate via transfer from a "transfer sheet." Specifically, the original drafting of the sublimation dye design is not done on the surface of the thermofused substrate itself. Rather, the transfer sheet is used as a carrier of the sublimation dye design. An example of a transfer sheet suitable for this purpose is described in U.S. Pat. No. 4,908,345, issued Mar. 13, 1990 to Egashira et al., which is incorporated herein by reference.

Figure 2:
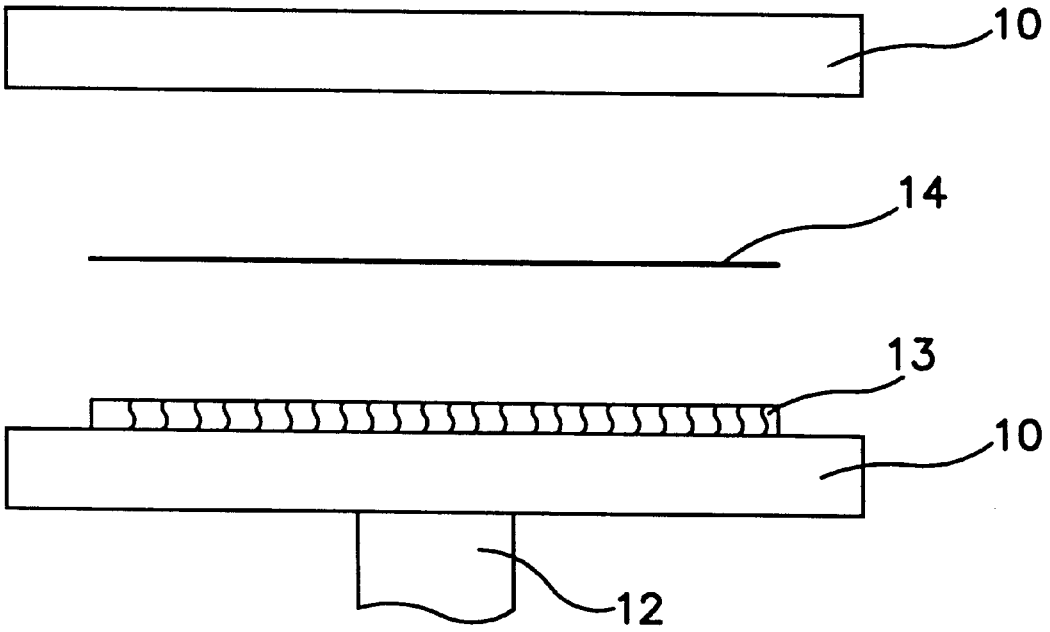
FIG. 2 is a schematic drawing of an embodiment of the invention according to which a sublimation dye design from a transfer sheet is transferred to a thermofused substrate under heat and pressure using an electric press.

FIG. 2 refers to an electric press which, while not capable of reaching temperatures and pressures as high as the oil press referred to in FIG. 1, allows for a more even distribution of temperature and pressure than the oil press. Referring to FIG. 2, two electric press platens 10 are positioned opposite each other. Placed between the two platens, juxtaposed against the surface of one of the platens, is the thermofused substrate 13. Placed between the thermofused substrate and the opposite platen is the transfer paper 14 which holds the subliminal dye decoration.

The electric press applies heat and pressure to the transfer sheet 14 and thermofused substrate 13 to cause penetration of the design on the sheet into the substrate through a sublimation process. "Sublimation" describes the process through which solids transform directly into gases without going through an intermediate liquid state. Certain dyes undergo this sublimation process when heated. If the gas that results from such dye sublimation can penetrate the surface of a particular material, it is possible to color that material. Moreover, as opposed to simply adding a coat of color film to the surface of the material, the material itself changes to the new color(s).

There are practical advantages to coloring a material with sublimation dyes as opposed to simply adding a coat of color film to the surface of the material. First, the dye-sublimation method results in more permanent color, as there is no film coat to abrade or fade. Second, the dye-sublimation method does not physically alter the surface of the material as, for instance, adding a coat of color film would. Finally, there is no significant change in the weight of the material colored.

Most sublimation dyes activate, or begin to transform from the solid to the gaseous state, at a temperature of about 250° F. However, at 250° F., the sublimation process would be extremely slow. As the temperature is increased, the conversation to vapors becomes more rapid., becoming nearly instantaneous at 410° F.

In order for the sublimation dyes to deeply color the thermofused substrate, the vapors formed by heating the dyes must be able to penetrate the surface of the thermofused substrate. The thermofused substrate is made penetrable by heating it to its transition temperature. When the thermofused substrate reaches its transition temperature, it expands to form openings that receive the dye. After the sublimation process has occurred and the sublimation dyes have penetrated the surface of the thermofused substrate, the substrate and dyes are allowed to cool. The sublimation dyes solidify and the thermofused substrate regains its original form. The sublimation dyes are now "trapped" inside the pores of the thermofused substrate.

This sublimation process will not be successful if an adequate temperature and pressure are not reached and sustained for a sufficient length of time. Furthermore, different temperatures, pressures and times are required for different types of wood substrates. Inadequate temperature and pressure for a particular wood substrate will preclude penetration of the sublimation dyes into the thermofused substrate. The sublimation dyes will instead remain on the surface of the thermofused substrate, allowing the color to fade, bleed or smear.

Referring again to FIG. 2, a hydraulic ram can 12 presses the platens together, thereby pressing together the transfer sheet and the thermofused substrate. The platens are heated via electric current which runs through the platens. Depending on the type of wood substrate, a particular pressure and temperature is maintained for the time required for the design to penetrate the thermofused substrate. It is well within the skill of the person of ordinary skill in the art to determine the conditions to successfully complete the sublimation process.

The transfer sheet is separated from surface of the thermofused substrate. After the sublimation process, the platens are allowed to cool. Once cool, the platens are pulled apart to their original position. The transfer sheet is then separated from surface of the thermofused substrate and the thermofused substrate removed from the electric press.

Optionally, a protective coating is applied over the surface of the thermofused substrate showing the transferred design. One example of a protective coating suitable for such a purpose is a UV cured polyester topcoat. Table 2 lists the ingredients of such a UV cured polyester topcoat. One such UV cured polyester topcoat can currently be obtained from Seagrave Coatings located in Carlstadt, New Jersey. The topcoat is commonly referred to as "UV curable acrylate."

TABLE 2

| Chemical Name | CAS Number | Wt. % is less than |
|---|---|---|
| Toluene | 108-88-3 | 10% |
| Styrene Monomer | 100-42-5 | 30% |
| Ethyl Acetate | 141-78 6 | 10% |
| UV Curable Resin | Mixture | 50% |
| Photoinitiator | 7473-98-5 | 5% |

Ingredients of UV cured polyester topcoat obtained from Seagrave Coatings located in Carlstadt, New Jersey.

EXAMPLE 1

Two oil press platens were positioned opposite each other. A smooth surface press-platten was affixed to the surface of each platen which faced the opposite platen. Different types of wood substrates, namely, MDF, plywood, isoboard, veneer core, and particle board, were alternatively placed between the two smooth surface press plattens and juxtaposed against the surface of one of the smooth surface press plattens. Polyester-impregnated paper obtained from Olon Industries located in Geneva, Ill., was placed between the wood substrate and the opposite smooth surface press platten.

The platens were pressed together by hydraulic rams, thereby pressing together the polyester-impregnated paper and the wood substrate. One of the platens was heated. For each different type of wood substrate, Table 3 lists the particular pressure and temperature which was maintained for the time required for the polyester to seep into the pores of the wood substrate to form the thermofused substrate.

TABLE 3

| Material | Pressure | Heat | Transition Time |
|---|---|---|---|
| MDF ¼"–⅜" | 1280 PSI | 265° F. | 55 sec. |
| MDF ½"–3½" | 1273 PSI | 260° F. | 150 sec. |
| Plywood ¼"–⅜" | 1280 PSI | 265° F. | 55 sec. |
| Plywood ½"–3½" | 1273 PSI | 260° F. | 150 sec. |
| Isoboard ¼"–⅜" | 1280 PSI | 265° F. | 55 sec. |
| Isoboard ½"–3½" | 1273 PSI | 260° F. | 150 sec. |
| Veneer Core ¼"–3½" | 1200 PSI | 270° F. | 90 sec. |
| Particleboard ¼"–⅜" | 1280 PSI | 265° F. | 55 sec. |
| Particleboard ½"–3½" | 1273 PSI | 260° F. | 150 sec. |

Pressure, heat and time values used to apply polyester-impregnated paper to different wood substrates.

The platens were then cooled and pulled apart to their original position, and the thermofused substrate was removed from the oil press.

The thermofused substrate was then placed between two electric press platens, juxtaposed against the surface of one of the platens. A sheet of transfer paper which held the subliminal dye decoration was placed between the thermofused substrate and the opposite platen. The platens were pressed together by a hydraulic ram can, thereby pressing together the transfer sheet and the thermofused substrate. The platens were then heated. For each different type of wood substrate, Table 4 lists the particular pressure and temperature which was maintained for the time required for the design to penetrate the thermofused substrate.

TABLE 4

| Material | Pressure | Heat | Transition Time |
|---|---|---|---|
| MDF | 70 PSI | 385 deg. F. | 55 sec. |
| Plywood | 50 PSI | 350 deg. F. | 50 sec. |
| Isoboard | 40 PSI | 360 deg. F. | 50 sec. |
| Veneer Core | 60 PSI | 375 deg. F. | 55 sec. |
| Particleboard | 50 PSI | 355 deg. F. | 55 sec. |

Pressure, heat and time values used to transfer sublimation dyes to different wood substrates.

The transfer sheet was then separated from surface of the thermofused substrate, and the platens were allowed to cool. Once cool, the platens were pulled apart to their original position. The transfer sheet was then separated from surface of the thermofused substrate and the thermofused substrate removed from the electric press. Finally, as a protective coating, a UV cured polyester topcoat obtained from Seagrave Coatings located in Carlstadt, N.J., was applied over the surface of the thermofused substrate showing the transferred design.

What is claimed is:

1. A process for transferring a decorative sublimation dye design formed on a transfer sheet to a wood substrate comprising:

(a) applying a sheet of cellulose web material to at least one surface of the wood substrate, wherein the cellulose web material is impregnated with a thermosetting resin;

(b) consolidating the sheet of cellulose web material to the wood substrate under heat and pressure such that the cellulose web material has seeped into the pores of the wood substrate to form a thermofused substrate;

(c) bringing the transfer sheet in contact with the surface of the thermofused substrate;

(d) applying heat and pressure to the transfer sheet and thermofused substrate to cause penetration of the design on the transfer sheet into the thermofused substrate through a sublimation process; and (e) separating the transfer sheet from the surface of the thermofused substrate.

2. The process as claimed in claim 1, wherein the cellulose material is paper.

3. The process as claimed in claim 1, wherein the thermosetting resin is polyester.

4. The process as claimed in claim 3, wherein the polyester impregnated web material includes an aluminum oxide.

5. The process as claimed in claim 1, wherein the cellulose material is paper and the thermosetting resin is polyester.

6. The process as claimed in claim 5, wherein the polyester impregnated web material includes an aluminum oxide.

7. The process as claimed in claim 1, wherein a protective coating is applied over the surface of the thermofused substrate showing the transferred design.

8. The process as claimed in claim 7, wherein the protective coating comprises a UV cured polyester topcoat.

9. The process according to claim 1, wherein the wood substrate is selected from the group consisting of MDF, plywood, isoboard, veneer core, particle board and hard board.

10. The process according to claim 1, wherein the thermofused structure is formed at a temperature of about 260° F. to about 333° F. and a pressure of about 1200 PSI to about 1280 PSI.

11. The process according to claim 1, wherein the design is transferred and penetrated into the surface of the web at a temperature of about 355° F. to about 385° F. and a pressure of about 50 PSI to about 70 PSI.

* * * * *